United States Patent [19]

Kokubo et al.

[11] Patent Number: 4,491,623

[45] Date of Patent: Jan. 1, 1985

[54] DOUBLE-LAYER ELECTROPLATED STEEL ARTICLE WITH CORROSION RESISTANCE AFTER PAINTING AND WET ADHESION OF PAINT FILM

[75] Inventors: Ichiro Kokubo, Kakogawa; Shigeki Kirihara, Kobe; Hirohiko Sakai; Masatoshi Iwai, both of Kakogawa, all of Japan

[73] Assignee: Kabushiki Kaisha Kobe Seiko Sho, Kobe, Japan

[21] Appl. No.: 396,448

[22] Filed: Jul. 8, 1982

[30] Foreign Application Priority Data

Jul. 14, 1981 [JP] Japan ..... 56-110551

[51] Int. Cl.[3] ..... B32B 15/01

[52] U.S. Cl. ..... 428/658; 428/935

[58] Field of Search ..... 428/658, 659, 926, 935; 204/40, 43 Z

[56] References Cited

U.S. PATENT DOCUMENTS

| | | | |
|---|---|---|---|
| 3,420,754 | 1/1969 | Roehl | 428/935 |
| 4,252,866 | 2/1981 | Matsudo et al. | 204/40 |

FOREIGN PATENT DOCUMENTS

| | | | |
|---|---|---|---|
| 56-293 | 1/1981 | Japan | 204/43 Z |
| 56-158864 | 12/1981 | Japan | 428/658 |
| 47987 | 3/1982 | Japan | 427/433 |

*Primary Examiner*—L. Dewayne Rutledge
*Assistant Examiner*—Robert L. McDowell
*Attorney, Agent, or Firm*—Oblon, Fisher, Spivak, McClelland & Maier

[57] ABSTRACT

An article of manufacture comprising a steel substrate coated with an electroplated metallic double layer with good corrosion resistance after painting and wet adhesion of paint film; said article having on the steel substrate a first layer of electroplated Zn-Ni alloy containing 7–15 wt % of Ni and on the first layer and, on said first layer, a second electroplated layer of iron or Fe-Zn alloy containing more than 60% of Fe and less than 40% of Zn.

3 Claims, 5 Drawing Figures

DOUBLE-LAYER ELECTROPLATED STEEL ARTICLE WITH CORROSION RESISTANCE AFTER PAINTING AND WET ADHESION OF PAINT FILM

BACKGROUND OF THE INVENTION (1) Field of the Invention

This invention relates to a double-layer electroplated steel sheet which has excellent properties in corrosion resistance after painting and wet adhesion of paint film.

(2) Description of the Prior Art

Galvanized steel sheets with high corrosion resistance are widely used for materials which are expected to be exposed to highly corrosive environments. Recently, various kinds of galvanized steel sheets are increasingly employed in the automobile industry mainly for interior panels of vehicle bodies to ensure a higher corrosion resistance. In such a case, the galvanized steel sheet is used after coating a primer by electrophoretic painting so that it is usually required to have satisfactory properties in corrosion resistance after painting and adhesion strength of paint film, especially in paint adhesion after immersion in hot water, in addition to uncoated (naked) corrosion resistance. However, the conventional electrogalvanized or hot dip galvanized steel sheets are inferior to cold rolled steel sheets in the wet adhesion of paint film. Galvannealed steel sheets are higher in wet adhesion of paint film than the electrogalvanized or hot dip galvanized steel sheets but are still slightly inferior to cold rolled steel sheets in that property, leaving a problem to be solved before application to exterior panels of vehicle bodies. Therefore, there has been a strong demand for zinc-coated steel sheets with high wet adhesion of paint film comparable to that of cold rolled steel sheets.

The application of galvanized steel sheets to the automobile bodies involves another difficulty in that galvanized sheets with heavy zinc coating weight are low in weldability in spot welding which is frequently resorted to in the automobile industry. The increased use of the galvanized steel sheets is reflected by a greater zinc content in the steel scraps to be recycled, giving rise to a problem in the melting stage of the scraps. In view of these problems or difficulties and for the purpose of cost reduction, there has been a growing demand for galvanized steel sheets which have a light zinc coating weight and yet can ensure a corrosion resistance comparable to that of the conventional couterparts.

In this connection, electroplating of an alloy such as Zn-Ni and Zn-Fe has been attracting special attention. The mono-layer electroplating of Zn-Ni or Zn-Fe has long been known in the art as a means for providing a corrosion resistant coating. The method of such alloy elecroplating and the properties of the plated layer are known, for example, from "Electrodeposition of alloys" by A. Brenner, 1963, Academic Press. Among them, the electrodeposited Zn-Ni alloy has excellent properties especially in corrosion resistance but, similarly to the conventional galvanized steel sheets, it is inferior to the cold rolled steel sheets in wet adhesion of paint film. On the other hand, the electroplated Zn-Fe alloy layer which is considered to have good corrosion resistance particularly in an Fe content range of 7–30% is still inferior to the Zn-Ni alloy electroplating. However, with regard to paintability, it excells pure zinc coating and Zn-Ni electroplating and is comparable to galvannealing.

SUMMARY OF THE INVENTION

With the foregoing situations in view, the present invention has as its object the provision of a plated steel sheet which is satisfactory in both corrosion resistance after painting and wet adhesion of paint film.

It is a more particular object of the present invention to provide a steel sheet which is imparted with high corrosion resistance after painting and wet adhesion of paint film by double-layer electroplating.

According to the present invention, these objects are attained by a double-layer electroplated steel sheet having a lower electroplated layer of Zn-Ni alloy containing 7–15% of Ni and an upper electroplated layer of Fe alone or Fe-Zn alloy containing more than 60% of Fe.

The above and other objects, features and advantages of the present invention will become apparent from the following description and appended claims, taken in conjunction with the accompanying drawings.

DETAILED DESCRIPTION OF THE INVENTION AND PREFERRED EMBODIMENTS

The percentages which will appear in the following description are all percentages by weight unless otherwise specified.

Figure 1:
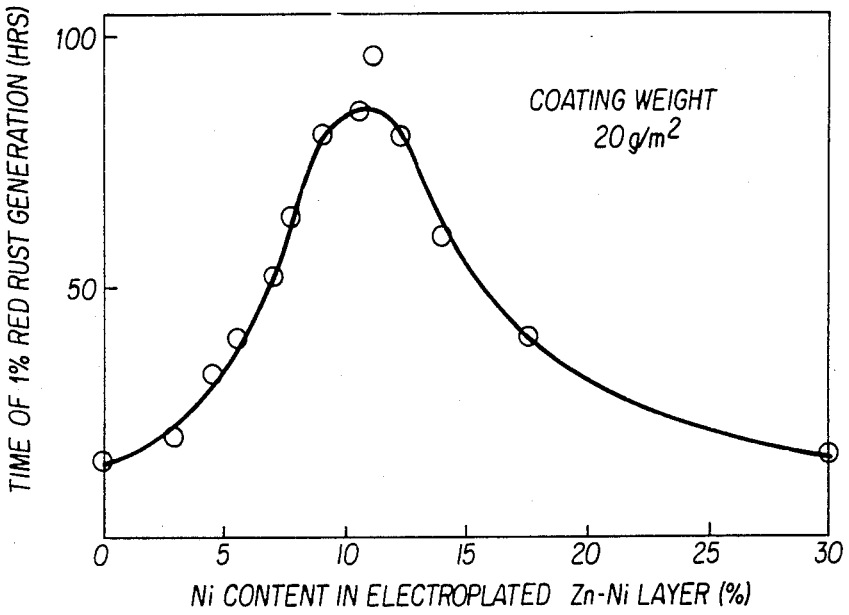
FIG. 1 is a diagram of the corrosion resistance versus Ni-content in an electroplated Zn-Ni layer in salt spray test.

In the present invention, the lower electroplated layer of Zn-Ni alloy which is formed firstly on the substrate steel sheet is essential for guaranteeing high corrosion resistance. FIG. 1 shows the relationship between the Ni content in the electroplated Zn-Ni alloy layer and the corrosion resistance (in terms of time of 1% red rust generation in salt spray test). As clear therefrom, the corrosion resistance of the plated layer becomes insufficient when the Ni content in the electroplated Zn-Ni alloy layer is smaller than 7%. The corrosion resistance is also deteriorated with an Ni content in excess of 15%. Consequently, the suitable range of the Ni content of the first layer of electroplated Zn-Ni alloy is 7 to 15% and preferably 9 to 13%. In addition, the coating weight of the first layer is desired to be greater than 3 $g/m^2$ for ensuring uniform coating and more preferably greater than 5 $g/m^2$ for maintaining high corrosion resistance. Although a greater coating weight of the first electroplated layer is reflected by a high corrosion resistance, an unduly large coating weight is not only economically wasteful but also disadvantageous in that it will impose adverse effects on the spot welding and the workability of the coated layer. Taking these into account, the coating weight of the first layer is desirably limited to 140 g/m$^2$ and from the standpoint of workability to 100 g/m$^2$.

The second layer to be formed on the above-described first layer is an electroplated layer of iron alone or Fe-Zn alloy containing more than 60% of Fe. The second layer is necessary for producing crystals of phosphophyllite ($Zn_2Fe(PO_4)_24H_2O$) in the stage of phosphate treatment prior to painting. The second layer contributes to the improvement of paint adhesion, especially to wet adhesion of paint film, and at the same time has an excellent effect in improving corrosion resistance after painting.

Following are the reasons why the second layer is restricted to electroplating of iron or Fe-Zn alloy with an Fe content greater than 60%.

Figure 2:
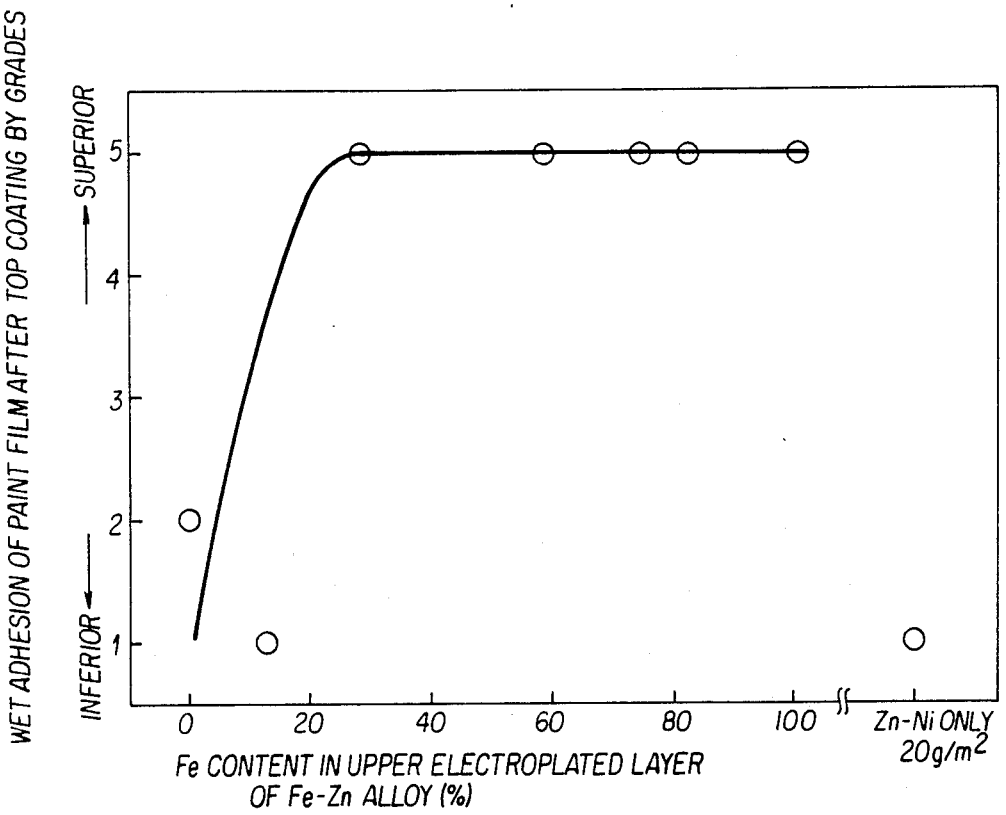
FIG. 2 is a diagram of the Fe content in an upper electroplated layer of Fe-Zn alloy versus the wet adhesion of paint film after top coating.
Figure 3:
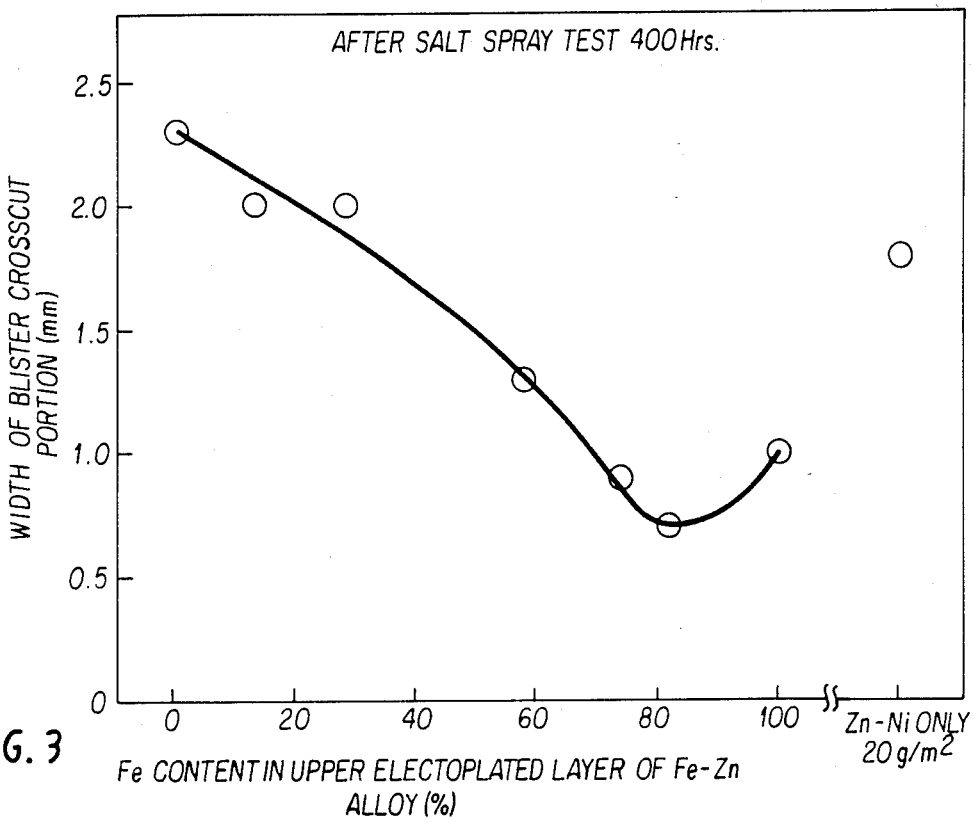
FIG. 3 is a diagram of the Fe content in the upper electroplated layer of Fe-Zn alloy versus corrosion resistance after painting.

As mentioned hereinbefore, the electroplating of Zn-Ni alloy is inferior in wet adhesion of paint film in the case of cathaphoretic painting which is most popular lately in the coating processes of automobile bodies. FIG. 2 shows the results of a test which was conducted to study wet adhesion, using specimens with second electroplated Fe-Zn layers of different Fe contents on the first electroplated Zn-Ni layers. It will be clear therefrom that the wet adhesion is unsatisfactory when the Fe content of the second electroplated layer is smaller than 13% and that the wet adhesion can be improved markedly with Fe contents greater than 28%. Referring to FIG. 3, there is shown the relationship between the Fe content of the second electroplated Fe-Zn layer and the corrosion resistance after cathaphoretic painting (in terms of increases in width of blister at cut portions). As seen therein, the coated layer shows good corrosion resistance with blistering of a smaller width at cross-cut portions when the Fe content is larger than 60% (or when the Zn content is smaller than 40%). The corrosion resistance is further enhanced as shown by the appearance blisters of smaller width when the Fe content is greater than 70% (i.e., when the Zn content is less than 30%), particularly in the range of Fe content of 70–90%. As seen in FIG. 3, the blistering width at the crosscut portions becomes minimum when the Fe content is about 80%.

Figure 4:
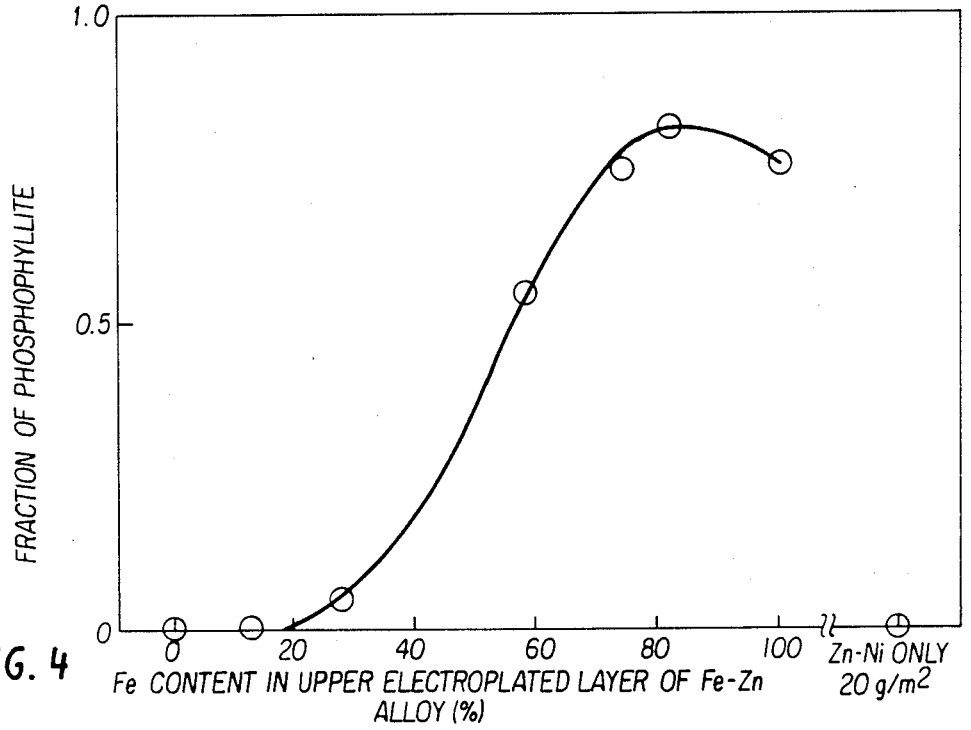
FIG. 4 is a diagram of the Fe content in the upper electroplated layer of Fe-Zn alloy versus proportion of phosphophyllite in the phosphate film.

Thus, the wet adhesion of paint film and the corrosion resistance after painting depend on the Fe content of the electroplated Fe-Zn layer, presumably for the following reasons. In the stage of phosphate (zinc-phosphate) treatment which is generally adopted prior to the paint coating process, crystals of hopeite ($Zn_3(PO_4)_24H_2O$) are produced on the pure Zn coating and Zn-Ni alloy plating, in contrast to phosphophyllite ($Zn_2Fe(PO_4)_24H_2O$) which is produced on cold rolled steel sheet in the phosphate treatment by dissolving iron of the substrate iron into the coated film. As known in the art, phosphophyllite is superior to hopeite in acid and alkali resistance. The diagram of FIG. 4 shows the relationship between the Fe content in the second electroplated Fe-Zn alloy layer and the fraction of phosphophyllite in the phosphate film. The fraction of phosphophyllite as expressed by the equation, $$\text{phosphophyllite fraction} = I_P/(I_P+I_H)$$

in which $I_p$ and $I_H$ are diffraction intensities on plane (100) of phosphophyllite ($Zn_2Fe(PO_4)_2.4H_2O$) and on plane (020) of hopeite ($Zn_3(PO_4)_2.4H_2O$) in X-ray diffraction. In the phosphate treatment of the electroplated Fe-Zn alloy layer, hopeite alone is produced in a case where the Fe content is smaller than 25%, and phosphopyllite is produced along with hopeite in a case where the Fe content is greater than 25%, the proportion of phosphophyllite becoming larger in response to increases in the Fe content of the electroplated Fe-Zn alloy layer as seen in FIG. 4. More specifically, the proportion of phosphophyllite reaches a high level with an Fe content greater than 60% (namely, with an Zn content smaller than 40%), and a higher level with an Fe content greater than 70%, marking the maximum level at the Fe content of 80%. Besides, at the 80% Fe content, the crystals of the coated phosphate film take the form of fine blocks which are very akin to the crystals on the cold rolled steel sheets. If the steel sheet which has been treated with phosphate is immersed in warm water subsequent to a painting process said process including cathaphoretic painting, surfacer coating and top coating, the water which reaches the phosphate film after permeation through the paint film exhibits alkalinity because of the unreacted components which remain in the cathaphoretic painting film. Therefore, the phosphate film with a large proportion of phosphophyllite which has high alkali resistance is considered to be less soluble in the permeated water, ensuring a higher wet adhesion as compared with a phosphate film which is smaller in the proportion of phosphophyllite. In addition, the phosphate film having a larger proportion of phosphophyllite is more resistive to acidic and alkaline corrosive products which appear in a corrosion test like salt spray test, so that it reduces the blistering of the paint film, thereby improving the corrosion resistance after painting as well.

For the reasons stated above, the second layer is restricted to electroplating of iron alone or Fe-Zn alloy containing more than 60% of Fe and less than 40% of Zn. A maximum corrosion resistance after painting can be obtained by electroplating of Fe-Zn alloy containing more than 70% of Fe and less than 30% of Zn, preferably containing 70–90% of Fe.

The coating weight of the second layer is restricted for the following reasons. The plated layer is dissolved off about 1 g/m$^2$ in the phosphate treatment prior to the painting process. Since the phosphophyllite of the phosphate film is produced by taking in the dissolved Fe of the plated layer, the second layer is completely dissolved off if the coating weight of the second layer is smaller than about 1 g/m$^2$, as a result increasing the proportion of hopeite of the phosphate film and deteriorating the wet adhesion and corrosion resistance after painting. In this connection, an increase in the coating weight of the second layer does not lead to improvement of wet adhesion and corrosion resistance after painting. On the contrary, if the second layer is too large in coating weight, it is likely that Zn-Ni of the first layer is selectively corroded when the second layer bears a bruise or bruises. Therefore, the coating weight of the second layer should be limited to about 15 g/m$^2$. In consideration of the loss of the second layer in the subsequent press-forming stage, the most suitable range of the deposition of the second layer is about 2 to 6 g/m$^2$.

Although it is possible to form the second layer by a method other than the above-mentioned electroplating, for example, by electroless plating, replacement plating or spray coating, the electroplating is preferred for its high productivity.

The invention is illustrated more particularly by the following examples.

EXAMPLE 1

After electrolytic degreasing and pickling, the first Zn-Ni alloy layer was electroplated on cold rolled steel sheets of 100 mm×120 mm×0.8 mm(t) by the following method.

| [Electroplating the first Zn—Ni alloy layer] | |
|---|---|
| Plating bath: | |
| Zinc sulfate ($ZnSO_47H_2O$) | 200 g/l |
| Nickel sulfate ($NiSO_46H_2O$) | 300 g/l |
| pH of bath | 1.5 |
| Bath temperature | 60° C. |
| Current density | 30 A/dm$^2$ |
| Anode | Pt-coated Ti plate |
| coating weight | 16 g/m$^2$ |
| Ni % in Zn—Ni alloy plating | 11% |

The steel sheets which were plated with the first Zn-Ni alloy layer were subsequently washed with water to electroplate the second layer under the following conditions.

| [Electroplating the second iron or Fe—Zn alloy layer] | |
|---|---|
| Plating bath | |
| Ferrous sulfate ($FeSO_47H_2O$) | 300 g/l |
| Ammonium sulfate ($(NH_4)_2SO_4$) | 30 g/l |
| pH of bath | 2.0 |
| Bath temperature | 60° C. |
| Current density | 30 A/dm$^2$ |
| Anode | Iron plate |
| Coating weight | 4 g/m$^2$ |

In the case of Fe-Zn alloy plating, zinc sulfate was added to the iron plating bath indicated above. The additive amounts of zinc sulfate and the Fe contents in the resulting Fe-Zn alloy plating were as shown in Table 1 below.

TABLE 1

Additive amounts of zinc sulfate & Fe contents in plated Fe—Zn alloy layers

| | Additive amount of zinc sulfate | Fe contents in plated Fe—Zn layers |
|---|---|---|
| Invention | 10 g/l | 82% |
| | 15 g/l | 74% |
| Comparative Example | 30 g/l | 58% |
| | 100 g/l | 28% |
| | 200 g/l | 13% |

In a case of pure zincing, the second layer was plated by an ordinary method using a sulfate bath.

For the purpose of comparison, specimens were prepared with Zn-Ni plating alone at a coating weight of 20 g/m$^2$, the plated steel sheet specimens according to the present invention as well as the steel sheets of the comparative examples were painted by an ordinary painting process for automobiles, including a phosphate treatment (dip method), cathaphoretic painting, surfacer coating, water sanding, and top coating.

After top coating, the specimens were subjected to crosscut (2 mm×2 mm, 100 squares) and peeling test after immersion in 40° C. water for 240 hours to examine wet adhesion of the paint film. The results are shown in FIG. 2. As seen therefrom, the examples of the invention are all good in wet adhesion.

Nextly, the corrosion resistance was tested by the salt spray method, after making crosscut in the electrophoretically painted specimens, with the results as shown in FIG. 3. It will be seen therefrom that the specimens according to the present invention are smaller in blistering width at the crosscut portions.

FIG. 4 shows the results of measurement of phosphophyllite fraction in the phosphate film in relation with the Fe content of the second layer. In the specimens according to the present invention, the rate of phosphophyllite was greater than 0.5, with a phosphate film resembling in shape the phosphate film on a cold rolled steel sheet.

EXAMPLE 2

Figure 5:
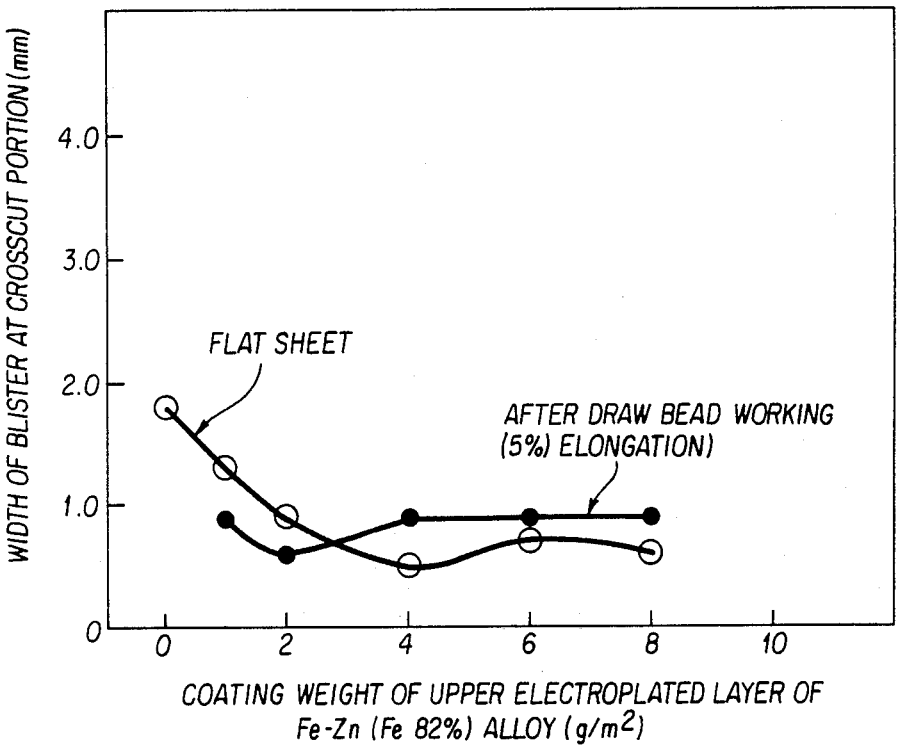
FIG. 5 is a diagram of the coating weight of the upper electroplated layer versus corrosion resistance after painting.

The first layer of Zn-Ni(11%) alloy layer was plated on cold rolled steel sheets of 100 mm×120 mm×0.8 mm(t) at a coating weight of 16 g/m$^2$ by the same procedures as in Example 1, followed by plating of the second Fe-Zn (82%Fe) layer at a deposition rate varying in the range of 1–8 g/m$^2$. The resulting specimens were subjected to the salt spray test after phosphate treatment by the dip method and electrophoretic painting. Some specimens were subjected to simulated draw bead working (5% elongation) prior to the phosphate treatment. The results are shown in FIG. 5. As seen therefrom, the specimens which were greater than 1 g/m$^2$ in the coating weight of the second layer showed superior painted corrosion resistance with a smaller blister width as compared with the single layer of Zn-Ni. In addition, the specimens according to the invention proved to be excellent surface-treated steel sheets with no deteriorations in the painted corrosion resistance even after the draw bead working.

EXAMPLE 3

Coils of a 0.7 mm thick and 500 mm wide cold rolled steel sheets were plated with the first layer of Zn-Ni alloy and the second layer of Fe-Zn alloy on an electroplating test line under the conditions similar to Example 1 to prepare specimens with three different coating weight of 4/16 g/m$^2$, 4/36 g/m$^2$ and 4/56 g/m$^2$ (by way of the expression of the coating weight of the second layer/the coating weight of the first layer). The Ni content of the first layer of Zn-Ni alloy plating was 10–12%, while the Fe content of the second layer of Fe-Zn alloy plating was 80–85%. The plated steel sheets were subjected to the salt spray test after the dipping phosphate treatment and cathaphoretic painting, along with electrogalvanized steel sheets and galvannealed steel sheets which served as comparative specimens. Some specimens were subjected further to wet adhesion test after coating the surfacer and top coat. The results are shown in Table 2.

TABLE 2

Results of salt spray test and wet adhesion test

| | Specimens | Corrosion resistance after electrophoretic painting (1) | Wet adhesion (Grade) (2) |
|---|---|---|---|
| Invention | 1st layer of 16 g/m$^2$ Zn—Ni + 2nd layer of 4 g/m$^2$ Fe—Zn | 0.7 mm | 5 |
| | 1st layer of 36 g/m$^2$ Zn—Ni + 2nd layer of 4 g/m$^2$ Fe—Zn | 0.8 mm | 5 |
| | 1st layer of 56 g/m$^2$ Zn—Ni + 2nd layer of 4 g/m$^2$ Fe—Zn | 0.7 mm | 5 |
| Compara- | Electrogalvanized steel sheet of 40 g/m$^2$ | 2.7 mm | 1–3 |

TABLE 2-continued

| | Specimens | Results of salt spray test and wet adhesion test: Corrosion resistance after electrophoretic painting (1) | Wet adhesion (Grade) (2) |
|---|---|---|---|
| tive | Galvannealed steel sheet of 45 g/m$^2$ | 2.0 mm | 4 |

(1) Blister width at the crosscut portion of the paint film 400 hours after the salt spray test (JIS Z 2371).
(2) The results of crosscut (2 mm = 2 mm, 100 squares) and peeling test after 240-hour immersion in 40° C. water, expressed by the grades of 1 to 5. A greater figure indicates a higher adhesion.

The specimens according to the present invention revealed to have higher painted corrosion resistance and wet adhesion of paint film than the conventional electrogalvanized or galvannealed steel sheets.

As clear from the foregoing description, the steel sheet according to the present invention is excellent particularly in the corrosion resistance after painting and free of exfoliations of plated layers in the working stage. In view of the superiority to the conventional electrogalvanized and galvannealed steel sheets in spot weldability, it is particularly suitable for application to automobile bodies.

What is claimed as new and desired to be secured by Letters Patent is:

1. An article of manufacture comprising a steel substrate coated with an electroplated double layer with good corrosion resistance after painting and wet adhesion of paint film, said steel article having on a steel substrate a first layer of electroplated Zn-Ni alloy containing 7–15 wt% of Ni and on said first layer a second layer of a metallic material selected from the group consisting of iron and Fe-Zn alloys containing more than 60% iron.

2. An article of manufacture as set forth in claim 1, where the metal substrate is a steel sheet.

3. A double-layer electroplated steel sheet as set forth in claim 2, wherein said steel sheet is provided with a first layer of electroplated Zn-Ni alloy containing 7–15% of Ni and a second layer of electroplated Fe-Zn alloy containing more than 60% of Fe and less than 40% of Zn.

* * * * *